US005924229A

United States Patent [19]

Brice

[11] Patent Number: 5,924,229

[45] Date of Patent: Jul. 20, 1999

[54] FLARE LAUNCHER

[75] Inventor: William F. Brice, Lakewood, Calif.

[73] Assignee: Skyblazer, Inc., Fullerton, Calif.

[21] Appl. No.: 09/014,306

[22] Filed: Jan. 27, 1998

[51] Int. Cl.[6] ..... F41C 3/02

[52] U.S. Cl. ..... 42/1.15; 42/42.03; 42/70.08; 89/27.12

[58] Field of Search ..... 42/1.15, 1.09, 42/42.03, 70.08; 89/27.12

[56] References Cited

U.S. PATENT DOCUMENTS

| | | | |
|---|---|---|---|
| 521,202 | 6/1894 | Burgees . | |
| 530,467 | 12/1894 | Balensiefer . | |
| 652,583 | 6/1900 | Baird . | |
| 788,866 | 5/1905 | Webber | 42/1.09 |
| 1,436,534 | 11/1922 | Russell et al. | 42/26 |
| 1,788,443 | 1/1931 | Sedgley | 42/1.15 |
| 1,858,601 | 5/1932 | Sedgley . | |
| 1,947,834 | 2/1934 | Driggs, Jr. et al. | 42/1.15 |
| 2,042,934 | 6/1936 | Gill | 42/1.09 |
| 2,050,861 | 8/1936 | Rolston | 42/1.16 |
| 2,055,020 | 9/1936 | Wadsworth . | |
| 2,076,927 | 4/1937 | Weber . | |
| 2,351,268 | 6/1944 | Jackson | 42/1.15 |
| 3,270,455 | 9/1966 | Smernoff et al. . | |
| 3,619,930 | 11/1971 | Beermann et al. | 42/1.15 |
| 3,913,482 | 10/1975 | Schiessl et al. . | |
| 3,979,850 | 9/1976 | Schiessl et al. . | |
| 4,176,606 | 12/1979 | King et al. | 42/1.15 |
| 4,266,357 | 5/1981 | Greenleaf . | |
| 4,592,159 | 6/1986 | Diederichs, Jr. . | |
| 4,644,930 | 2/1987 | Mainhardt | 42/16 |

*Primary Examiner*—Stephen M. Johnson
*Attorney, Agent, or Firm*—Frank J. Uxa

[57] ABSTRACT

Apparatus for launching flares includes a handle portion adapted to be held in a hand of a human being when the apparatus is used, a barrel portion coupled to the handle portion and defining a hollow barrel through which a flare projectile passes in being launched, and an enabling assembly slidably secured to the handle portion and being adapted to be moved between a first position in which the apparatus is not enabled to launch a flare and a second position in which the apparatus is enabled to launch a flare.

18 Claims, 2 Drawing Sheets

FLARE LAUNCHER

BACKGROUND OF THE INVENTION

The present invention relates to apparatus for launching flares. More particularly, the invention is related to apparatus for manually launching flares, for example, 12 gauge flare shells, safely, effectively and reliably.

Flares are well known as signaling devices, for example, to warn of distress in emergency, to signal one's location, to provide a specific, e.g., color coded, message and the like. Various devices have been used to launch flares. These devices are often shaped similarly to hand-held pistols which include an elongate barrel and a handle which depends from the barrel at a right angle or an acute angle relative to the longitudinal axis of the barrel.

Although these devices are effective to launch flares, for example, in the form of 12-gauge flare shells, they do have drawbacks. For example, the prior art launching devices are relatively easy to mis-direct, that is, relatively easily fire flares horizontally or even downwardly rather than upwardly. A mis-directed flare represents a safety hazard and is substantially ineffective for its intended purpose. Also, since an explosion is involved and the flare exits the barrel at a relatively high rate of speed, it was important, for example, for safety reasons, that the launching be effectively controlled to minimize mistakenly launching the flare. On the other hand, the launcher should be sufficiently straightforward to allow a flare to be launched relatively easily. Further, the prior art launchers are often made of metal which sink if placed in water. This is an important concern since flare launchers are often used on boats or other water craft.

There continues to be a need for new flare launchers which address one or more of these concerns.

SUMMARY OF THE INVENTION

New apparatus for launching flares have been discovered. Such apparatus are straightforward in construction and use, and provide enhanced effectiveness and safety in use. In addition, the present flare launchers are relatively compact, particularly in storage, preferably are effective to hold a plurality of flare shells ready for launching, and preferably are floatable in water.

In general, the present flare launchers comprise a handle portion adapted to be held in a hand of a human being when the apparatus is used and a barrel portion coupled to the handle portion and defining a hollow barrel through which a flare projectile passes when being launched.

In one particularly useful embodiment, the handle portion has a first handle end, an opposing second handle end and a handle longitudinal axis passing through the first and second handle ends. The barrel portion has a first barrel end, an opposing second barrel end a barrel longitudinal axis passing through the first and second barrel ends. In this embodiment, the handle longitudinal axis and the barrel longitudinal axis are substantially aligned, that is are substantially coincidental, when the apparatus is used to launch a flare. Thus, the barrel and handle can be considered an aligned or straight system which is adapted to be held in a hand of a human being. Thus, when it is desired to launch a flare, the handle portion is very conveniently held in a straight up and down position. This very conveniently causes the barrel also to extend in a straight up and down orientation. When the trigger assembly, e.g., part of the handle portion, is activated, a firing assembly, e.g., also in the handle portion impacts the flare, causing the flare to be fired. The flare projectile passes through the barrel and is launched in a generally upwardly direction. Moreover, with this "aligned" configuration of the present flare launcher, it is very difficult to turn the apparatus so that the barrel is pointing in a horizonal or downwardly extending direction. This is an important feature effective to avoid launching the flare in a direction which can cause damage to another person or to property located in the vicinity of the person launching the flare.

In another embodiment, the present apparatus further comprise an enabling assembly secured to the handle portion and adapted to be moved between a first position in which the apparatus is not enabled to launch a flare and a second position in which the apparatus is enabled to launch a flare. This embodiment provides for enhanced safety in that the enabling assembly must be moved to the second position prior to the flare being launched. Thus, after the flare is placed in the hollow barrel, a second step is taken, that is movement of the enabling assembly to the second position, before the flare can be fired. The additional step provides a substantial safety feature to the present invention and avoids mistaken firing of a flare located in the barrel. However, the enabling assembly can be easily moved, for example, slid, from the first position to the second position to enable launching of the flare. Thus, the enabling assembly provides enhanced safety while being easily moved, when desired, to enable the apparatus to launch a flare.

In a further aspect of the present invention, the barrel portion is adapted to be pivoted relative to the handle portion, for example, during storage of the apparatus. Thus, during storage, the barrel can be folded relative to the handle portion, preferably so that the longitudinal axis of the barrel is substantially parallel to the longitudinal axis of the handle. This feature allows the apparatus to assume a very compact configuration during storage.

In one embodiment, a flare holder assembly is provided and is adapted to hold a plurality of flares. This holder assembly includes a first end member adapted to be secured to the first end of the handle portion and a second end member adapted to be removably secured to the opposing second end of the handle portion, for example, during storage of the apparatus. The second end member preferably is effective to cover and protect the firing mechanism, located in the handle portion, when the second end member is removably secured to the second end of the handle portion. When an individual flare is to be used, it is removed from the holding assembly and placed in the barrel portion. The holder assembly preferably is adapted to allow manual removal of an individual flare from the flare holder assembly for manual placement in the barrel portion. The second end member is removed from the handle portion and the barrel portion is joined to the handle portion, preferably is pivoted or rotated relative to the handle portion, so that the firing mechanism located in the handle portion is aligned with the flare in the barrel portion.

The enabling assembly preferably is moved from the first position to the second position to enable the apparatus to fire the flare. Once this movement of the enabling assembly has occurred, the apparatus is aimed, for example, so that the barrel portion is pointing in a generally upwardly direction. A trigger assembly, preferably located in the handle portion, is coupled to the firing mechanism. The trigger assembly is activated which causes the firing mechanism to impact the flare in the barrel portion and cause a flare projectile, derived from the flare, to be launched.

In addition, the handle portion preferably is constructed to facilitate the apparatus being floatable in water. For example, the handle portion and barrel portion preferably are made of polymeric material and, more preferably, the handle portion includes one or more hollow chambers which facilitate the apparatus being floatable in water. In addition, all or one or more portions of the apparatus are brightly colored, e.g., red, orange, yellow and the like, to enhance the visibility of the apparatus, for example, in the water.

In one very useful embodiment, the enabling assembly, in the first position, interferes with the movement of the firing mechanism in the handle portion. In the second position, the enabling assembly does not interfere with the movement of the firing assembly. With the enabling assembly in the first position, the firing mechanism preferably is unable to make contact with the flare in the barrel portion. With the enabling assembly in the second position, the firing mechanism preferably is able to contact or impact the flare in the barrel portion. In any event, with the enabling assembly in the second position, the trigger assembly can be activated to cause the firing mechanism to cause the launching of the flare projectile.

Preferably, the enabling assembly includes a pin member located in a space defined within the handle portion. The pin member preferably is effective in securing the enabling assembly to the handle portion. The pin member included in the enabling assembly preferably is adapted to contact the firing mechanism when the enabling assembly is in the first position and remain out of contact with the firing mechanism with the enabling assembly in the second position.

The barrel portion preferably includes means, such as a marking or other indicia on or in the outside surface of the barrel portion, to facilitate a determination, for example, a visual and/or tactile determination by the user of the apparatus, that the enabling assembly is in the second position.

Methods of launching flares using the present apparatus are provided and included within the scope of the present invention. Such methods comprise placing a flare in the barrel portion of the apparatus, moving the enabling assembly to the second position and causing the flare to be fired, thereby launching a flare projectile derived from the flare.

Preferably, the above-noted placing step occurs with a barrel portion being pivotably separated from the handle portion and, thereafter, the barrel portion and the handle portion are pivotably joined together prior to the moving step. The causing step preferably includes activating the trigger assembly to allow movement of the firing mechanism toward the flare.

Each and every feature, or combination of two or more features, described herein is included within the scope of the present invention, provided that the features included in the combination are not mutually inconsistent.

These and other aspects of the present invention are apparent in the following detailed description and claims, particularly when considered in conjunction with the accompanying drawings in which like parts bear like reference numerals.

DETAIL DESCRIPTION OF THE DRAWINGS

Figure 1:
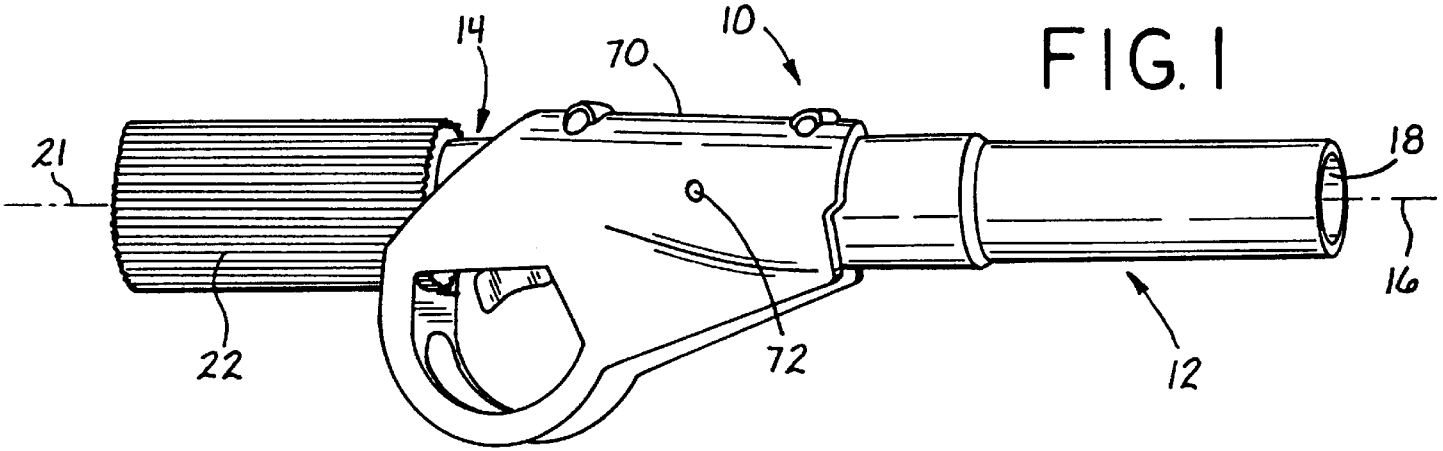
FIG. 1 is a front prospective view of a flare launcher in accordance with the present invention and in condition ready for firing a flare.

With reference to the drawings, FIGS. 1 to 5 show a flare launcher, shown generally at 10, including an elongate barrel portion 12 and a handle portion 14. Barrel portion 12 has a barrel longitudinal axis 16 and defines a hollow space 18 through which flare projectile 20 passes in being launched. Handle portion 14 has a handle longitudinal axis 21 and includes a hand grip 22 which is adapted to be gripped by a hand of a human being when using apparatus 10. Handle portion 14 also includes firing mechanism 24, which has a firing pin 26. Handle portion 14 further includes a trigger assembly 28 having a trigger 30 and luer 32 which is pivotably coupled to the trigger. The firing assembly 24 includes firing spring 25 which urges the firing pin 26 toward barrel portion 12. Trigger assembly 28 includes a trigger spring 29 and a luer spring 31 which are used, ultimately, in allowing the trigger assembly to be activated to cause firing pin 26 to impact against the base 34 of flare 36 to launch flare projectile 20. Flare 36 is a conventional 12-gauge flare shell, although apparatus 10 can be sized and configured to launch any suitably sized flare and the like device.

Figure 2:
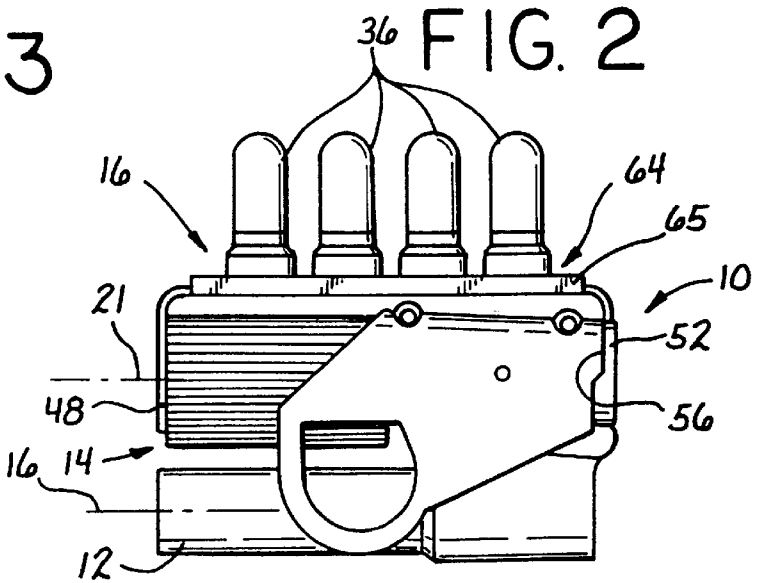
FIG. 2 is a front plan view of the embodiment shown in FIG. 1 including a flare holder assembly and being in the folded state.
Figure 3:
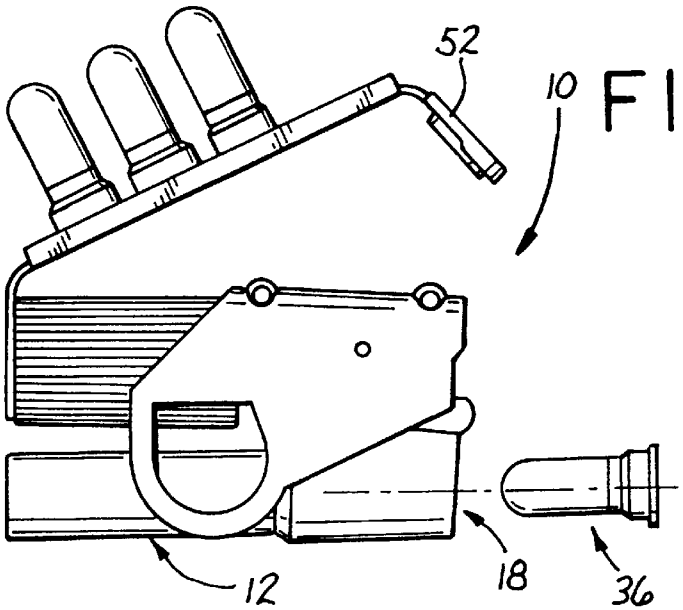
FIG. 3 is a front plan view of the embodiment shown in FIG. 2 being prepared to launch a flare.

During storage of the apparatus 10, barrel portion 12 is pivoted around pivot pin 40, which also acts to join or couple together the barrel portion and the handle portion 14, so that the barrel longitudinal axis 16 is substantially parallel to the handle longitudinal axis 21, as shown in FIGS. 2 and 3. This provides a very compact folded state, e.g., for storage.

Apparatus 10 is shown in this folded state in FIGS. 2 and 3. In addition, as shown in FIGS. 2 and 3, the apparatus 10 includes a flare holding assembly 46 which includes a first end member 48 secured to and covering the first end opening 13 (FIG. 1) of handle portion 14. Holding assembly 46 also includes a second end member 52 which is secured to the second end 56 of handle portion 14. With both first end member 48 and second end member 52 secured to the handle portion 14, as shown in FIG. 2, the hollow chamber 60 (FIG. 1) defined by handle 14 is sealed and has a sufficient volume, together with the polymeric material construction of apparatus 10, to allow the apparatus 10, in the folded state to be floatable in water. In addition, the second end portion 52 of holding assembly 46 covers and protects the firing mechanism 24 and trigger mechanism 28 within handle portion 14. Substantially the entire exterior of apparatus 10, other than hand grip 22 is bright red in color to enhance the visibility of the apparatus.

The primary purpose of holding assembly 46 is to hold a number of flares 36 ready for launching by apparatus 10. Although a number of constructions are possible, in one embodiment the base 64 of holding assembly 46 is provided with opposing sidewalls 65 designed to allow the flares 36 to be snugly held to the holding assembly so that they cannot escape other than by being manually moved along the base until being manually removed from the holding assembly at the forward end (the right end in FIG. 2) of the base.

FIG. 3 demonstrates what occurs when it is desired to launch a flare 36. Second end member 52 is removed from the handle portion 14. One of the flares 36 is removed from the holder assembly 46 and is placed in the hollow space 18 of barrel portion 12.

Figure 4:
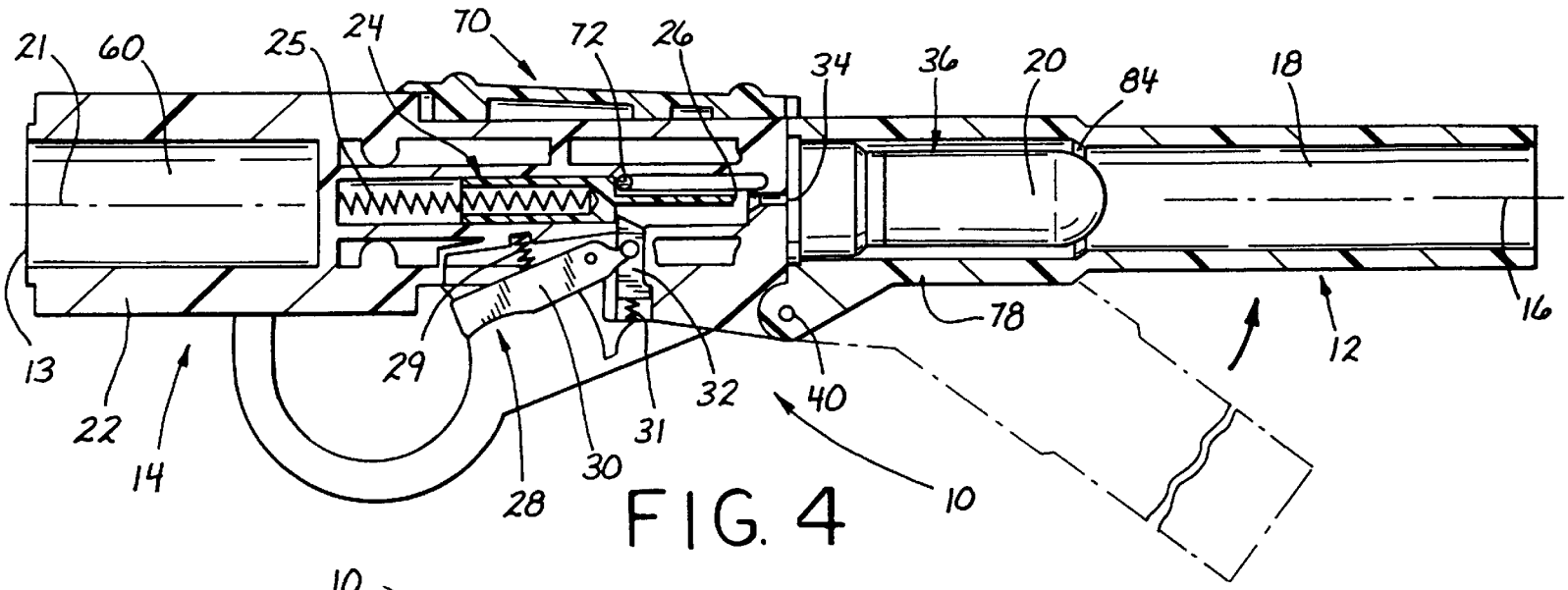
FIG. 4 is a front view, partly in cross section, showing the embodiment of FIG. 1 being moved from the folded state to the intermediate nonenabled state.
Figure 5:
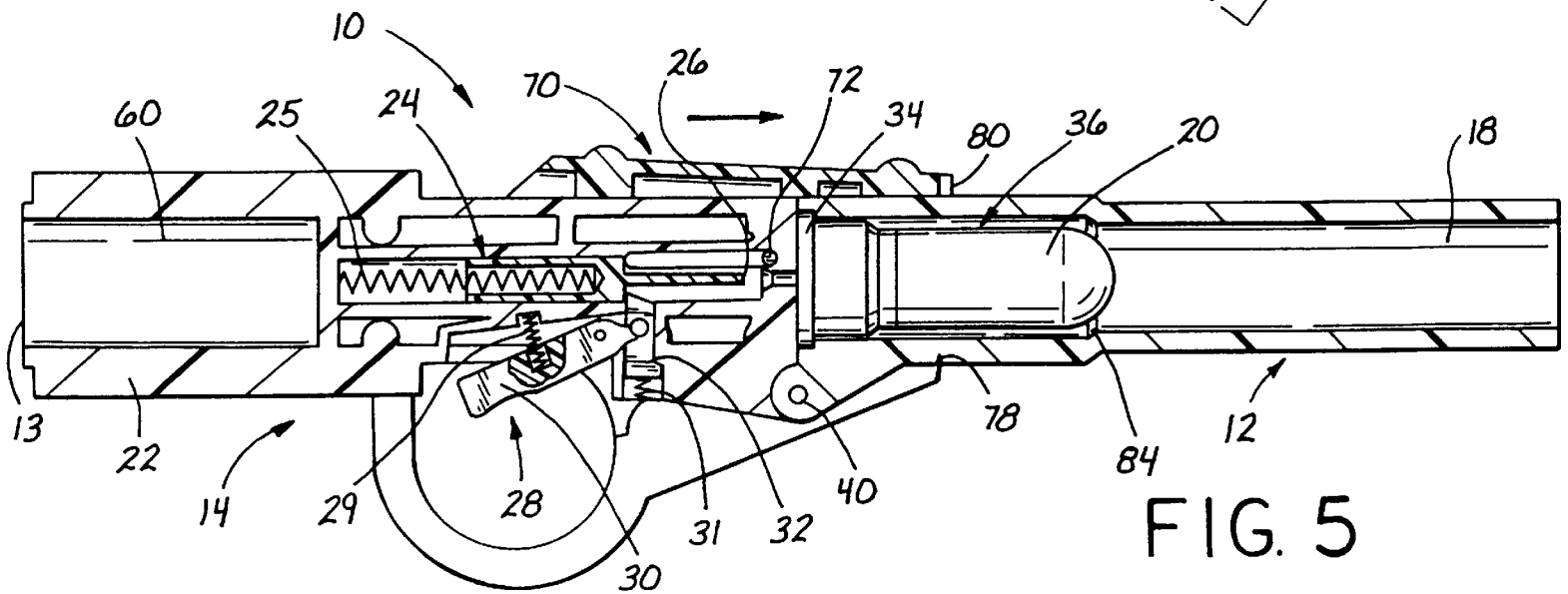
FIG. 5 is a front view, partly in cross section, of the embodiment shown in FIG. 1 in the enabled state.

FIGS. 4 and 5 are shown, for clarity, without the holding assembly 46 attached. However, if desired, the holding assembly 46 can be maintained secured to the handle portion 14 (with first end member 48 secured at first end opening 13) during use of the apparatus 10.

With the flare 36 in place in hollow space 18, the barrel portion 12 is pivoted around pivot pin 40 so that barrel longitudinal axis 16 is aligned with handle longitudinal axis 21, as shown in FIG. 4.

An enabling assembly 70 is provided which is secured to the handle portion 14 by pin 72 which extends completely through the handle portion. Pin 72 is part of, e.g., is secured to, enabling assembly 70. With enabling assembly 70 located in a first position, shown in FIG. 4, pin 72 is in contact with the firing mechanism 24. This prevents firing mechanism 24, and in particular firing pin 26, from moving forward to come in contact with base 34 of flare 36. Enabling assembly 70 in the first position does not allow the apparatus 10 to launch this flare 36.

In order to enable apparatus 10 to launch this flare 36, enabling assembly 70 is moved forward, as shown in FIG. 5, to a second position in which pin 72 is positioned outside of the path of firing mechanism 24 and firing pin 26. A visually and tactilely recognizable marking 78 on the outside surface of barrel portion 12 is positioned to coincide with the front surface 80 of enabling assembly 70 being in the second position. Thus, marking 78 can be used to make a visual and/or tactile determination that the enabling assembly 70 is in the second position.

With enabling assembly 70 in the second position, the apparatus 10 is ready to launch flare 36 in hollow space 18. The human user grips hand grip 22 and points it generally upwardly. He or she then pulls (presses) trigger 30 inwardly which causes luer 32 to move allowing firing spring 25 of firing mechanism 24 to move firing pin 26 forward to contact base 34 of flare 36. This causes flare 36 to explode causing the launching of flare projectile 20 through hollow space 18 into the air above. Hollow space 18 includes a downwardly tapered section 84 sized and adapted to allow flare projectile 20 to pass, but to maintain base 34 within the hollow space.

The present apparatus are relatively easy and inexpensive to manufacture. Moreover, such apparatus are straightforward and effective in use. They preferably are compactly foldable for storage, float in water, and have substantial safety features. In short, the present apparatus have one or more significant advantages over previous flow launchers.

While this invention has been described with respect to various specific examples and embodiments, it is to be understood that the invention is not limited thereto and that it can be variously practiced within the scope of the following claims.

What is claimed is:

1. An apparatus for launching flares comprising:

a handle portion adapted to be held in a hand of a human being when the apparatus is used, the handle portion having a first handle end and a second handle end and a handle longitudinal axis passing through the first and second handle ends;

a barrel portion pivotably coupled to the handle portion and defining a hollow barrel through which a flare projectile passes in being launched, the barrel portion having a first barrel end and a second barrel end and a barrel longitudinal axis passing through the first barrel end and the second barrel end;

an enabling assembly slidably secured to the handle portion and adapted to be moved axially along the handle longitudinal axis between a first position in which the apparatus is not enabled to launch a flare and a second position in which the apparatus is enabled to launch a flare; and wherein the handle longitudinal axis and the barrel longitudinal axis are substantially aligned when the apparatus is used to launch a flare.

2. The apparatus of claim 1 wherein the barrel portion is adapted to be pivoted relative to the handle portion so that the barrel longitudinal axis is substantially parallel to the handle longitudinal axis during storage of the apparatus.

3. The apparatus of claim 2 which further comprises a flare holder assembly adapted to hold a plurality of flares and including a first end member adapted to be secured to the first handle end and a second end member adapted to be removably secured to the second handle end during storage of the apparatus.

4. The apparatus of claim 1 wherein the handle portion includes a trigger assembly coupled to a firing mechanism, in the first position the enabling assembly interferes with the movement of the firing mechanism and in the second position the enabling assembly does not interfere with the movement of the firing assembly.

5. The apparatus of claim 4 wherein the enabling assembly includes a pin member located in a space defined by the handle portion, the pin member being effective in securing the enabling assembly to the handle portion.

6. An apparatus for launching flares comprising:

a handle portion adapted to be held in a hand of a human being when the apparatus is used, the handle portion having a first handle end and a substantially opposing second handle end and a handle longitudinal axis passing through the first and second handle ends;

a barrel portion coupled to the handle portion and defining a hollow barrel through which a flare projectile passes in being launched; and an enabling assembly slidably secured to the handle portion and being adapted to be moved axially along the handle longitudinal axis between a first position in which the apparatus is not enabled to launch a flare and a second position in which the apparatus is enabled to launch a flare, the handle portion including a trigger assembly coupled to a firing mechanism, in the first position the enabling assembly interferes with the movement of the firing mechanism and in the second position the enabling assembly does not interfere with the movement of the firing mechanism.

7. The apparatus of claim 6 wherein the enabling assembly includes a pin member located in a space defined by the handle portion, the pin member being effective is securing the enabling assembly to the handle portion.

8. The apparatus of claim 6 wherein the enabling assembly includes a pin member adapted to contact the firing mechanism with the enabling assembly in the first position and to remain out of contact with the firing mechanism with the enabling assembly in the second position.

9. The apparatus of claim 6 wherein the handle portion is structured to facilitate the apparatus being floatable in water.

10. The apparatus of claim 6 wherein the barrel portion is adapted to be pivoted relative to the handle portion during storage of the apparatus.

11. The apparatus of claim 10 wherein the handle portion include a first handle end and a second handle end, and which further comprises a flare holder assembly adapted to hold a plurality of flares and including a first end member adapted to be secured to the first handle end and a second end member adapted to be removably secured to the second handle end during storage of the apparatus.

12. A method of launching a flare comprising:

placing a flare in the barrel portion of the apparatus of claim 6;

axially moving the enabling assembly along the handle longitudinal axis to the second position; and causing the flare to be fired, thereby launching a flare projectile derived from the flare.

13. The method of claim 12 wherein the placing step occurs with the barrel portion being pivotably separated from the handle portion and, thereafter, the barrel portion and the handle portion are pivotably moved together prior to the moving step.

14. The method of claim 12 wherein the handle portion includes a trigger assembly coupled to a firing mechanism, in the first position the enabling assembly interferes with the movement of the firing mechanism and in the second position the enabling assembly does not interfere with the movement of the firing assembly, and the causing step includes activating the trigger assembly to allow movement of the firing mechanism toward the flare.

15. The method of claim 14 wherein the enabling assembly includes a pin member adapted to contact the firing mechanism with the enabling assembly in the first position and to remain out of contact with the firing mechanism with the enabling assembly in the second position, and the enabling assembly is in the first position during the placing step.

16. An apparatus for launching flares comprising:

a handle portion adapted to be held in a hand of a human being when the apparatus is used, the handle portion having a first handle end and a second handle end and a handle longitudinal axis passing through the first and second handle ends;

a barrel portion coupled to the handle portion and defining a hollow barrel through which a flare projectile passes in being launched, the barrel portion being adapted to be pivoted relative to the handle portion; and a flare holder assembly adapted to hold a plurality of flares and including a first end member adapted to be secured to the first handle end and a second end member adapted to be removably secured to the second handle end during storage of the apparatus.

17. The apparatus of claim 16 wherein the handle portion includes a trigger assembly coupled to a firing mechanism, and the second end member covers and protects the firing mechanism when the second end member is removably secured to the second handle end.

18. An apparatus for launching flares comprising:

a handle portion structured to facilitate the apparatus being floatable in water and adapted to be held in a hand of a human being when the apparatus is used, the handle portion having a first handle end and a substantially opposing second handle end and a handle longitudinal axis passing through the first and second handle ends;

a barrel portion pivotably coupled to the handle portion and defining a hollow barrel through which a flare projectile passes in being launched, the barrel portion having a first barrel end and a second barrel end and a barrel longitudinal axis passing through the first barrel end and the second barrel end;

an enabling assembly slidably secured to the handle portion and adapted to be moved axially along the handle longitudinal axis between a first position in which the apparatus is not enabled to launch a flare and a second position in which the apparatus is enabled to launch a flare; and wherein the handle longitudinal axis and the barrel longitudinal axis are substantially aligned when the apparatus is used to launch a flare.

* * * * *

UNITED STATES PATENT AND TRADEMARK OFFICE

CERTIFICATE OF CORRECTION

PATENT NO. : 5,924,229
DATED : July 20, 1999
INVENTOR(S) : Brice

It is certified that error appears in the above-identified patent and that said Letters Patent is hereby corrected as shown below:

Figure 2; delete "16" and insert in place thereof --46--.

Signed and Sealed this

Tenth Day of April, 2001

*Attest:*

Nicholas P. Godici

NICHOLAS P. GODICI

*Attesting Officer*

*Acting Director of the United States Patent and Trademark Office*